US006266027B1

(12) United States Patent
Neel

(10) Patent No.: US 6,266,027 B1
(45) Date of Patent: Jul. 24, 2001

(54) ASYMMETRIC ANTENNA INCORPORATING LOADS SO AS TO EXTEND BANDWIDTH WITHOUT INCREASING ANTENNA SIZE

(75) Inventor: Michael M. Neel, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/433,592

(22) Filed: Nov. 2, 1999

(51) Int. Cl.[7] ..... H01Q 1/36
(52) U.S. Cl. ..... 343/895; 343/749
(58) Field of Search ..... 343/895, 850, 343/749, 750, 751; H01Q 1/36

(56) References Cited

U.S. PATENT DOCUMENTS

| | | | | |
|---|---|---|---|---|
| 3,624,658 | | 11/1971 | Voronoff et al. | 343/895 |
| 3,828,351 | | 8/1974 | Voronoff | 343/895 |
| 4,243,993 | * | 1/1981 | Lamberty et al. | 343/895 |
| 4,605,934 | | 8/1986 | Andrews | 343/895 |
| 4,636,802 | * | 1/1987 | Middleton, Jr. | 343/895 |
| 4,658,262 | | 4/1987 | DuHamel | 343/895 |
| 5,508,710 | * | 4/1996 | Wang et al. | 343/895 |
| 5,619,218 | * | 4/1997 | Salvail et al. | 343/895 |
| 5,621,422 | * | 4/1997 | Wang | 343/895 |
| 5,808,587 | * | 9/1998 | Shima | 343/895 |
| 5,936,594 | * | 8/1999 | Yu et al. | 343/895 |
| 5,936,595 | * | 8/1999 | Wang | 343/895 |
| 5,990,849 | * | 11/1999 | Salvail et al. | 343/895 |

* cited by examiner

*Primary Examiner*—Don Wong
*Assistant Examiner*—Hoang Nguyen
(74) *Attorney, Agent, or Firm*—Earl H. Baugher, Jr.

(57) ABSTRACT

In a preferred embodiment, a spiral or helical antenna offering expanded operation at low frequencies while retaining a package size roughly equivalent to an unmodified antenna having a bandwidth not extended in low frequency. A preferred embodiment is a planar spiral antenna incorporating a pair of spiral arms, one arm of which has been modified to incorporate a capacitance at selected intervals along upper and lower surfaces of that arm so as to cause a phase shift in one of the input signals to the antenna. The input signal is provided by splitting at a balun a single signal into two equal amplitude signals 180° out of phase with each other. The subsequent phase shift permits the two out of phase input signals to be brought back into phase at calculated intervals prior to termination of the signals at the arms' ends.

17 Claims, 5 Drawing Sheets

Capacitively Loaded, Non-Symmetric Spiral

SECTION A-A

CAPACITIVELY LOADED, NON-SYMMETRIC SPIRAL ANTENNA BLOCK DIAGRAM

Capacitive Arm Spiral - Bottom

Capacitive Arm Spiral - Top

Capacitively Loaded, Non-Symmetric Spiral
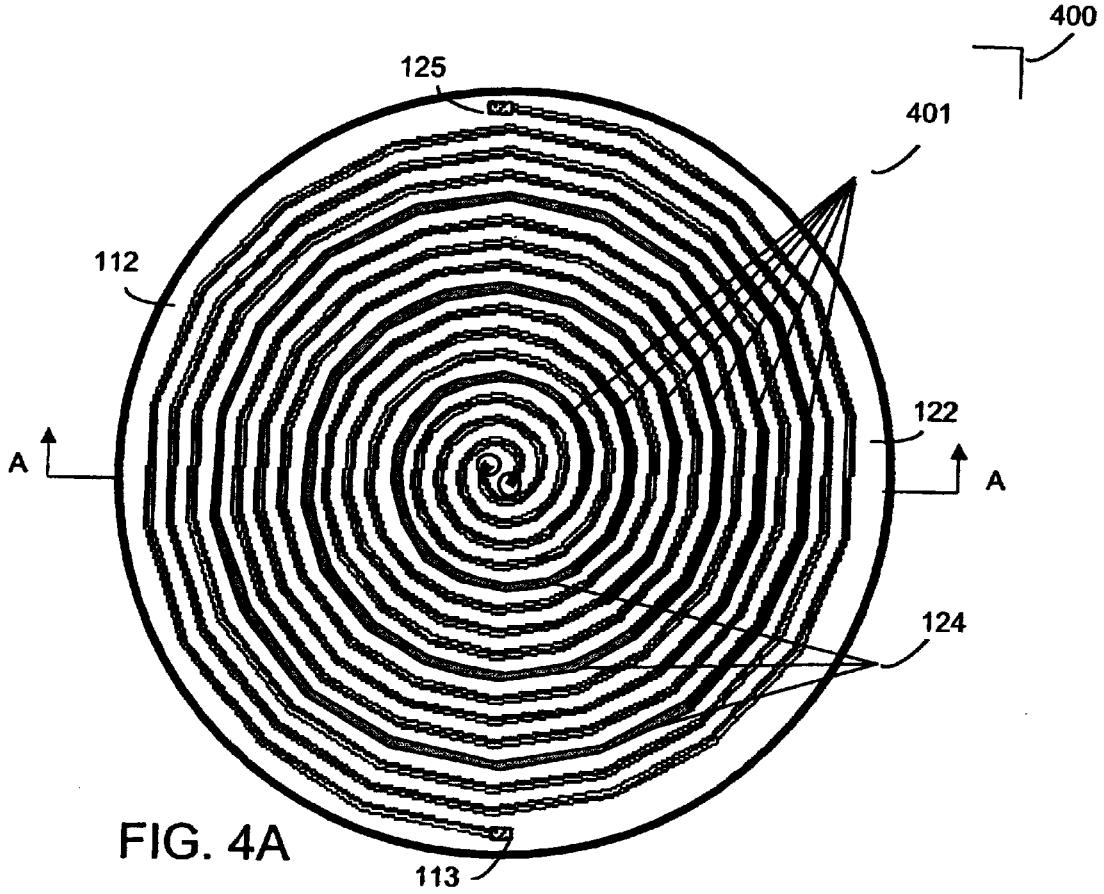
FIG. 4A
SECTION A-A
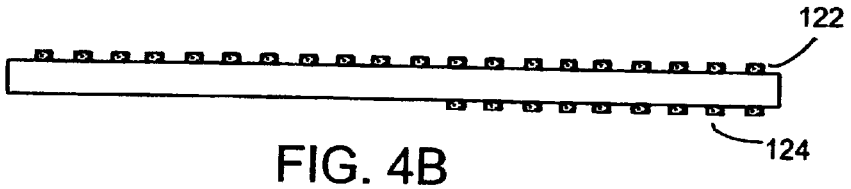
FIG. 4B
FIG.4

ASYMMETRIC ANTENNA INCORPORATING LOADS SO AS TO EXTEND BANDWIDTH WITHOUT INCREASING ANTENNA SIZE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

A preferred embodiment of the present invention pertains generally to antennas, and more particularly to spiral or helical antennas that require expanded operation at the low frequency end of their operating bandwidth, while retaining their original size.

BACKGROUND

Antennas made of lengths of wire are frequency sensitive as the length of wire approaches even intervals of operating wavelength, $\lambda$, i.e., $\lambda/4$, $\lambda/2$, $\lambda$, $2\lambda$, $4\lambda$, etc. An antenna of infinite length and configured according to a standard Archimedian or logarithmic geometry theoretically would operate independently of frequency of operation since its critical dimension would be defined by angle only. This being both impossible and impractical, there are two basic approaches to the design of "frequency-independent" (FI) antennas: 1) "shaping" of the wire layout of the antenna to specify antenna operation entirely by angles, and 2) "complementary shaping" such that the critical dimension of the wire itself, usually the longitudinal dimension, repeats in terms of $\lambda$. Examples of the first type are planar and conical equiangular spiral antennas, while those of the second type include log-periodic antennas. Further, by combining the best features of both approaches, i.e., periodicity and angle concepts, antennas having high bandwidths can be made. The designer is free to combine elements but when limited by packaging constraints such as those for aerospace vehicles, the antenna designer must seek alternative solutions when a requirement exists to extend the operating bandwidth to low operating frequencies, i.e., a physically long $\lambda$.

For an equiangular spiral antenna, energy radiates as the wave progresses along the antenna. Beyond that distance correlating to the circumference of the spiral that equals the operating $\lambda$, the antenna can be terminated. This determines the lowest frequency of operation. Hence, for a low frequency of operation, $c/\lambda$, a large circumference will be required, resulting in a large package to confine the antenna.

The precision at the input to the spiral determines the highest frequency of operation for the spiral antenna. Given that the mathematical representation for the radius to be used at an operating frequency corresponding to $\lambda_1$ is:

$$r_1 = r_0 e^{a(\phi_1 - \phi_0)} \tag{1}$$

where:

$r_1$=radial distance to the spiral corresponding to operating $\lambda_1$, cm $r_0$=fixed radius of the spiral antenna, cm a=constant related to rate of expansion of the antenna $\phi_1$=angle at $r_1$, radians $\phi_0$=angle at $r_0$, radians then, when operation changes to a new frequency corresponding to $\lambda_2$, the radial distance, $r_2$, for an FI spiral antenna will be given by:

$$r_2 = \left(\frac{\lambda_2}{\lambda_1}\right) r_1 \tag{2}$$

where:

$\lambda_1$=operating $\lambda$ for a frequency-independent design at $r_1$, cm $\lambda_2$=operating $\lambda$ for a frequency-independent design at $r_2$, cm $r_2$=radial distance to the spiral relating to operating at $\lambda_2$, cm and, thus:

$$r_2 = r_0 e^{a(\phi_2 - \phi_0)} \tag{3}$$

where:

$\phi_2$=angle at $r_2$, radians

The frequency coverage of a spiral antenna is inversely related to the inner and outer radii of the spiral itself. The inner radius determines the high frequency limit of operation and the outer radius the lower. The relationship describing the low frequency limit is given by:

$$D = N \times \left(\frac{\lambda}{\pi}\right) \tag{4}$$

where:

D=outer diameter of the spiral, cm

N=required highest order mode of operation $\lambda$=wavelength of basic frequency of operation, cm Attendant requirements for lower operating frequencies for new receiver and direction finding (DF) equipment have driven a number of attempts to broaden bandwidth response in a small package, all with very limited success usually resulting in overall performance degradation. Previous efforts at extending bandwidth to lower operating frequencies, so as to electrically lengthen the antenna without a proportional physical lengthening, included: 1) dielectric loading above or below the plane of the antenna such as described in U.S. Pat. No. 3,624,658, issued to Voronoff; 2) various resistive terminators for the antenna's arms such as described in U.S. Pat. No. 3,828,351, issued to Voronoff; and 3) symmetrically modulated arms such as described in U.S. Pat. No. 4,605,934, issued to Andrews. The most significant improvements evolved from a combination of planar and helical spiral arms, at the expense of a much larger package, such as described in U.S. Pat. No. 4,658,262, issued to DuHamel.

A requirement for an FI antenna both 1) able to operate within a bandwidth having an extended low operating frequency, i.e., at a longer $\lambda$, and 2) able to fit in existing packaging, created an as yet unmet need. Given the immutable nature of the conventionally-designed spiral or helical antenna in all of its mutations as described above, this need has not yet been filled. However, the need is addressed by a preferred embodiment of the present invention.

SUMMARY OF THE INVENTION

A preferred embodiment of the present invention contemplates an antenna having spiral arms deployed in pairs, one arm of each pair having a configuration that is defined with standard Archimedian or logarithmic geometry. The other arm of a pair is defined having the same geometry as its corresponding arm of the pair, but with series capacitive elements imposed on this arm. These capacitances are integrally formed (machined or etched or otherwise suitably formed) on the top and bottom of the plane in which the antenna arms lie, capacitively-coupling energy at pre-determined distances along the arms. The purpose of this introduced asymmetry is to increase the phase difference of signals traveling in a given pair of spiral arms of the antenna, forcing a phase concurrence at an earlier location along the spiral path of the arms prior to reaching the outer diameter of the arm, thus increasing the power able to be radiated (or increasing the sensitivity of a receiver). By judiciously choosing the location of these capacitive elements, bandwidth or circular polarization quality can be adjusted to meet an individual system requirement.

Advantages of preferred embodiments of the present invention include, but are not limited to, permitting:

- bandwidth extension to lower frequencies while incurring little or no penalty in package size;
- use of existing packages for systems able to operate at bandwidths extended to lower frequencies;
- reduction in antenna arm length of approximately 25% per octave bandwidth;
- flexibility in adjusting design parameters of bandwidth and polarization quality;
- simplified design of alternate configurations;
- inexpensive fabrication;
- low maintenance;
- high reliability since there are no additional components or moving parts; and
- ready upgradability of existing systems.

Preferred embodiments are fully disclosed below, albeit without placing limitations thereon.

BRIEF DESCRIPTION OF DRAWINGS

1.
FIG. 4A is a diagram of a top view of a preferred embodiment of the present invention.
5.
FIG. 4B is a cross-section view of a portion of the top and bottom loaded spiral arm taken at A—A of FIG. 4A.
6.

DETAILED DESCRIPTION

Figure 1:
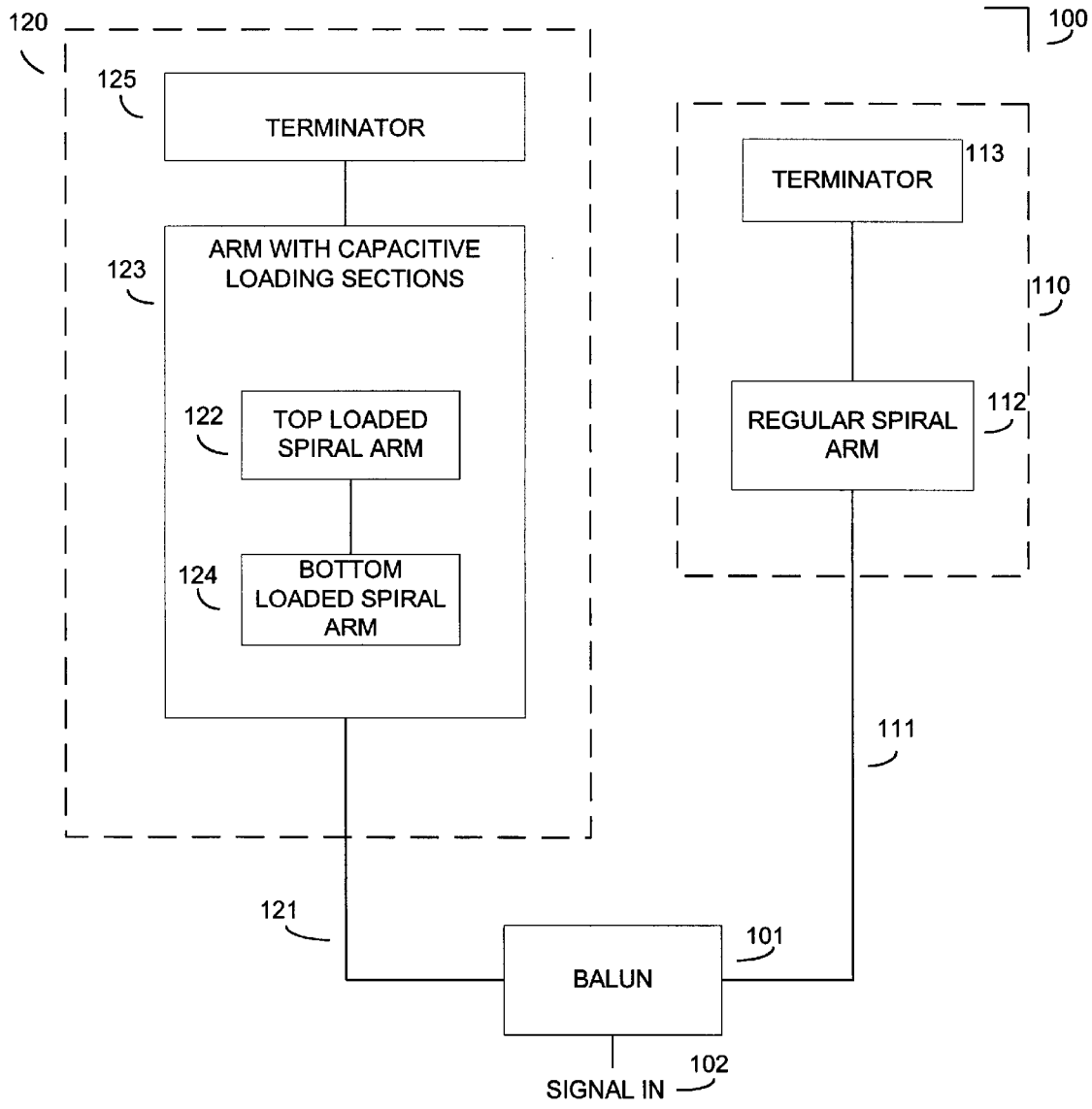
FIG. 1 is a diagram depicting signal flow in a pair of antenna in a preferred embodiment of the present invention.
2.

Referring to FIG. 1, a preferred embodiment of the present invention 100 comprises a pair of spiral arms 110 and 120 providing two paths 111 and 121 for input signal 102 to traverse after passing through balun 101. The balun 101 feeds the spiral arms 110 and 120 equal amplitude signals that are 180° out of phase with each other. This is known in the literature as the feed for a "Mode 1" antenna pattern, commonly used for a spiral antenna of conventional design.

One of the two signals from the balun 101 is fed to an antenna arm configuration 110 along path 111, commonly a coax cable, to a spiral arm 112, of conventional configuration representing one of a pair of arms of the antenna system 100, terminating in a current limiter 113, commonly a resistor to ground. The other signal, 180° out of phase with the first signal exiting the balun 101, is similarly fed to the antenna arm configuration 120 along path 121, commonly a coax cable, to a spiral arm 123, of unconventional configuration having capacitively loaded sections formed by at least one top loaded section 122 and at least one bottom loaded section 124, terminating in a current limiter 125, again commonly a resistor to ground. The capacitively loaded top and bottom sections 122 and 124 introduce the necessary phase delay that insures phase concurrence of the two signals from the balun 101 prior to termination at current limiters 113 and 125. The physical layout corresponding to the functional diagram is provided in FIGS. 4A and 4B.

The conventional spiral arms 112 geometry is mathematically represented by:

$$r = W \times \left(\frac{2}{\pi\theta}\right) \tag{5}$$

where:

r=radius to the arm at angle θ, cm

θ=angle at which r is measured, radians

W=arm width, cm

The capacitively-loaded top spiral arm's 122 geometry, having series capacitances imposed in the top of the plane containing the antenna itself, is also mathematically represented by Eqn. 5. However, this "geometry" is alternately interrupted at pre-determined $\theta_x$, thus creating discontinuous lines. These lines are coupled to the capacitively-loaded bottom spiral arm's 124 geometry, having series capacitances imposed in the bottom of the plane containing the antenna, also mathematically represented by Eqn. 5. The "geometry" of this bottom spiral arm 124 is interrupted at $\theta_x$, angles alternately less than and greater than those of the top spiral arm's 123, thus creating discontinuous lines (paths). This overlapped geometry creates capacitive sections electrically in series with the arms. The current in these capacitive sections of the unconventional, or capacitively-loaded, arm 123 and 124 leads that of the current in the conventionally-designed arm 112. This leads to phase concurrence in the signals traversing the sections 110 and 120 sooner than a conventional design and prior to termination of the separate signals in current limiters 113 and 125.

Figure 2:
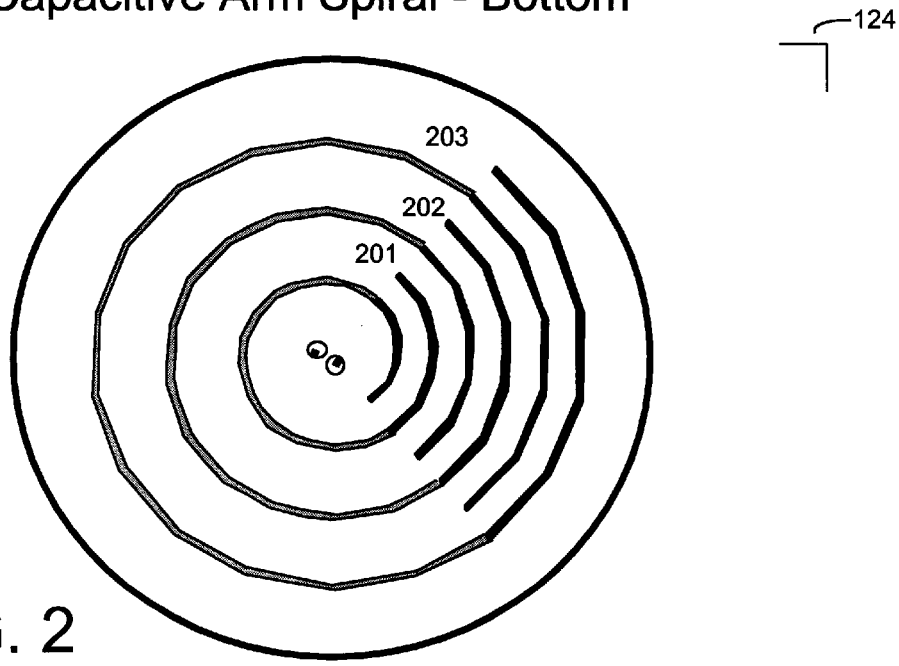
FIG. 2 is a view of a bottom capacitive arm spiral.
3.

FIG. 2 is a two-dimensional representation plotting radial distance in the x-y plane of the planar spiral antenna of a preferred embodiment of the present invention. It shows the start of representative discontinuities 201, 202, and 203 as would be expected in the bottom spiral arm 124 of FIG. 1. Likewise, FIG. 3 shows the start of representative discontinuities 301, 302, 303, and 304 as would be expected in the top spiral arm 122, but superimposed on the same depiction having a spiral having no discontinuities 112.

Figure 3:
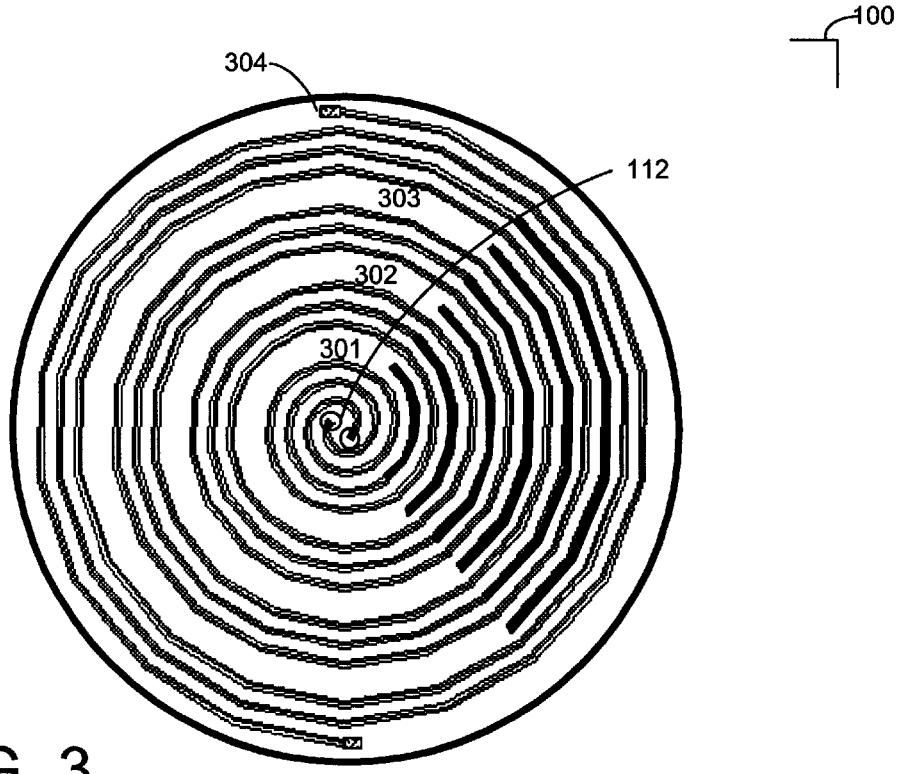
FIG. 3 is a view of a top capacitive arm spiral.
4.

FIG. 4A puts FIGS. 1, 2, and 3 together in a top view 400 of a system employing a single pair of arms in an antenna representing a preferred embodiment of the present invention. Capacitively-coupled sections 401 are represented as darkly-shaded sections of arm. The top loaded spiral arm 122 is represented by the black lines 122 while the bottom loaded spiral arm is represented by lightly-shaded sections of arm 124. The conventional spiral arm is represented by darkly-dashed lines 112 while the terminators are represented by a widening of the ends of arms 113 and 125.

FIG. 4B is a cross-section of a representative configuration of a preferred embodiment of the present invention taken at A—A through FIG. 4A. The calculated discontinuity in antenna loading can be seen "on end" as it were.

Figure 5:
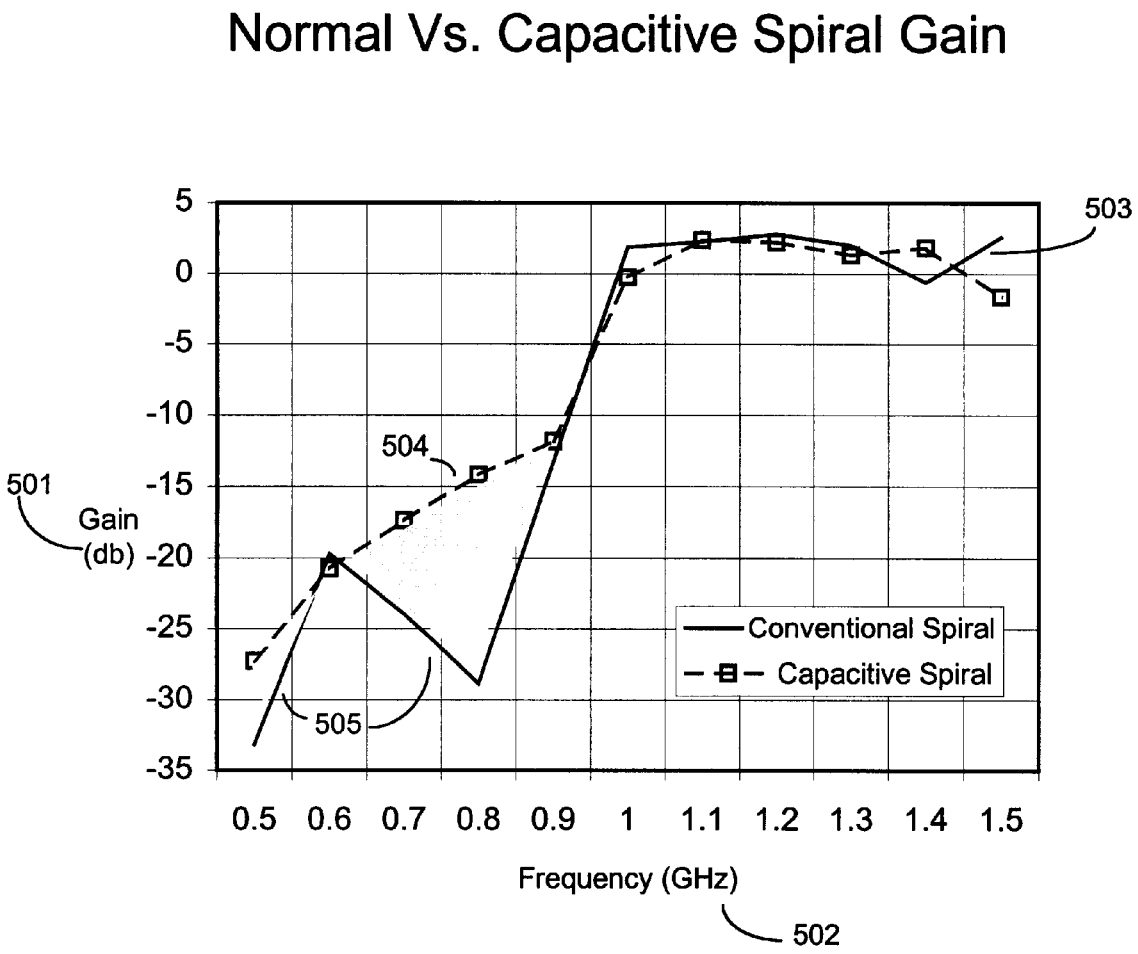
FIG. 5 depicts the increase in low frequency response afforded by a preferred embodiment of the present invention.
7.

FIG. 5 shows the improved performance in frequency response plotted as Gain (dB) 51 vs. Frequency Response (GHz) 52. The shaded areas 505 represent the areas of increase in low frequency response for a preferred embodiment of the present invention 504 as compared to a conventional spiral antenna 503.

Figure 6:
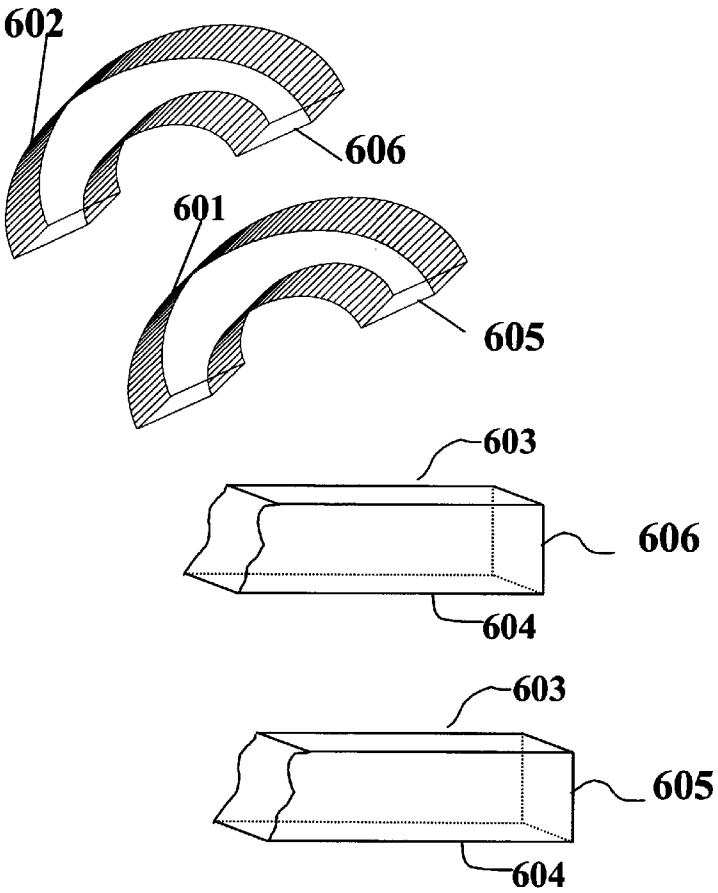
FIG. 6 depicts the relationship of the ends of a pair of arms used in a preferred embodiment of the present invention to the top and bottom longitudinal portions of the arms.

Accordingly, a preferred embodiment of the present invention provides a reliable, inexpensive, rugged, circularly-polarized antenna having expanded operational capabilities. FIG. 6 depicts two arms 601 and 602 of the a preferred embodiment of the present invention, their top 603 and bottom 604 longitudinal surfaces being in planes perpendicular to the surfaces of the ends 605 and 606 of the arms 601 and 602, respectively. Further, it offers extended low frequency operation in a small package and design flexibility in meeting stiff requirements that are imposed by military and law enforcement agencies, for example.

The above descriptions should not be construed as limiting the scope of the invention but as mere illustrations of preferred embodiments. The scope shall be determined by appended claims as interpreted in light of the above specification

I claim:

1. An apparatus for conducting energy at extended long wavelengths in a selectable bandwidth of operation, comprising:

a pair of electromagnetically conducting elements incorporating a reactive load formed integrally with the apparatus, and an electrical connection, wherein said apparatus is physically smaller than another apparatus performing the same function as said apparatus but without said reactive load formed integrally with said apparatus.

2. An antenna for conducting energy at extended long wavelengths in a selectable bandwidth of operation, comprising:

a pair of electromagnetically conducting elements incorporating a reactive load formed integrally with said antenna, and an electrical connection, wherein said pair of conducting elements are arms, each with an upper longitudinal surface and a lower longitudinal surface generally parallel to said upper longitudinal surface, each of said arms having two ends in a plane generally perpendicular to said surfaces, wherein said reactive load is a capacitor, and wherein said antenna is physically smaller than another antenna performing the same function as said antenna but without said reactive load formed integrally with said antenna.

3. The antenna of claim 2 wherein said apparatus is a planar spiral antenna.

4. The antenna of claim 2 wherein said apparatus is a helical antenna.

5. The antenna of claim 2 wherein said capacitor comprises at least two physical configurations placed at an interval along at least one arm of said pair of arms, the location of said capacitor at said interval being mathematically related to extending the bandwidth of operation of said antenna.

6. A system incorporating an apparatus for conducting energy at extended long wavelengths in a selectable bandwidth of operation, comprising:

a pair of electromagnetically conducting elements incorporating a reactive load formed integrally with said apparatus, and an electrical connection, wherein said system is physically smaller than another apparatus performing the same function as said apparatus but without said reactive load formed integrally with the apparatus.

7. The system of claim 6 wherein said apparatus is an antenna, wherein said pair of conducting elements are arms, each with an upper longitudinal surface and a lower longitudinal surface generally parallel to said upper longitudinal surface, each of said arms having two ends in a plane generally perpendicular to said surfaces, and said reactive load is a capacitor.

8. The system of claim 7 wherein said apparatus is a planar spiral antenna.

9. The system of claim 7 wherein said apparatus is a helical antenna.

10. The system of claim 7 wherein said capacitor comprises at least two physical configurations placed at an interval along at least one arm of said pair of arms, the location of said capacitor at said interval being mathematically related to extending the bandwidth of operation of said antenna.

11. A method of fabricating an energy conducting apparatus for extending long wavelength operation in a selectable bandwidth of operation, comprising:

suitably forming a pair of electromagnetically conducting elements, each of said pair of elements having one dimension, the longitudinal dimension, significantly longer than any other dimension, said, each said element having a longitudinal dimension with at least two generally parallel surfaces and two ends, a first end and a second end;

forming on said generally parallel surfaces of at least one of said pair of elements, at predetermined intervals, a reactive load; and affixing an electrical connection to each of said electrically conducting elements at said first ends, such that said apparatus is physically smaller than an apparatus performing the same function but without said reactive load formed integrally with the apparatus.

12. The method of claim 11 wherein said apparatus is a spiral antenna, having turns situated along a plane, and said reactive load is a capacitor.

13. The method of claim 12 wherein said capacitor is formed by suitably removing material from one of said generally parallel surfaces at generally the same location at which each of said turns are adjacent and directly over each other along either side of the plane along which said apparatus is formed.

14. The method of claim 12 wherein said capacitor is formed by a method selected from the group of methods consisting of: etching, physical ablation, cutting, grinding, and laser ablation.

15. The method of claim 11 wherein said second ends are terminated in a current limiter.

16. The method of claim 11 wherein said apparatus is a helical antenna, having turns oriented along said element's longitudinal dimension and traversing a plane perpendicular to said longitudinal dimension.

17. The method of claim 16 wherein said capacitor is formed by a method selected from the group of methods consisting of: etching, physical ablation, cutting, grinding, and laser ablation.

* * * * *